US005868001A

United States Patent [19]

Shoulders

[11] Patent Number: 5,868,001

[45] Date of Patent: Feb. 9, 1999

[54] SUCTION ACCUMULATOR WITH OIL RESERVOIR

[75] Inventor: Stephen L. Shoulders, Baldwinsville, N.Y.

[73] Assignee: Carrier Corporation, Syracuse, N.Y.

[21] Appl. No.: 985,978

[22] Filed: Dec. 5, 1997

[51] Int. Cl.[6] ..... F25B 43/00

[52] U.S. Cl. ..... 62/503; 62/470; 62/471

[58] Field of Search ..... 62/503, 474, 471, 62/84, 468, 470

[56] References Cited

U.S. PATENT DOCUMENTS 5,355,695 10/1994 Kawaguchi et al. ..... 62/503

*Primary Examiner*—John M. Sollecito

[57] ABSTRACT

The lowest metering port in the suction feed pipe of an accumulator is located such that a residual liquid storage volume is created which is at least 20% of the total volume available for liquid storage without overflowing into the suction feed pipe.

2 Claims, 2 Drawing Sheets

SUCTION ACCUMULATOR WITH OIL RESERVOIR

BACKGROUND OF THE INVENTION

In an inactive air conditioning, heat pump, or refrigeration system, refrigerant tends to condense and collect at cool and/or low locations in the system. For the range of indoor and outdoor temperatures encountered in many systems during the off-portions of their cycles, the compressor is often the coolest part of the system for some period of time. As a result, considerable liquid refrigerant may collect in both suction-side and discharge-side portions of the compressor, possibly degrading compressor reliability in several ways.

Liquid refrigerant that collects in the compressor oil sump dilutes the oil, reducing its ability to lubricate compressor bearings and other moving parts when the compressor is started. Liquid that condenses on the suction side of a compressor may be drawn into the compression mechanism at start-up and wash away lubricating oil films normally present on moving parts. Liquid that condenses on the suction side may also be delivered directly or indirectly into the compressor oil sump at start-up, thereby diluting oil with the possible consequences described above.

Because of the affinity between refrigerants and many of the lubricants used therewith, refrigerant may also migrate to, and dissolve into, the oil over time even when the compressor is not any cooler than other portions of the system, thereby contributing to oil dilution and attendant loss of lubricating ability. This phenomenon makes it very desirable to maintain a minimum oil charge amount-to-refrigerant charge amount ratio that will help ensure that the oil will have adequate lubricating quality even in the most diluted state. For the start-up transients of many typical systems using presently available refrigerants and oils, experimentation and field experience have resulted in an approximate guideline that the oil charge amount should be at least about 30 to 40% of the refrigerant charge amount.

To mitigate these problems a number of design approaches may be employed, one of which is a refrigerant accumulator. An accumulator is commonly used to collect liquid refrigerant on the suction-side of the compressor and then meter its flow rate to the compressor compression mechanism and/or oil sump at start-up. A typical accumulator consists of an inlet pipe, a volume for storing liquid, a suction feed pipe that provides a passage for refrigerant gas to enter the compression mechanism or oil sump, and a circuitous flow path. The circuitous flow path is interposed between inlet pipe and inlet of suction feed pipe to divert liquid refrigerant, entering via the inlet pipe, away from the inlet of the suction feed pipe and into the storage volume, aided by the action of gravity. Often the circuitous flow path is created using a baffle in which holes or passages that allow the passage of refrigerant are vertically misaligned relative to the inlet of the suction feed pipe. Other arrangements that do not use a baffle are also possible, such as vertical misalignment of inlet pipe and suction feed pipe inlet, for example.

At start-up, low pressure caused by the action of the compression mechanism tends to vaporize any liquid refrigerant residing in the liquid storage volume and draws the vapor towards the compression mechanism via the suction feed pipe. Converting the liquid refrigerant to vapor in this manner helps avoid the washing of oil films and/or dilution of sump oil that might otherwise occur if liquid refrigerant were allowed to enter the compression mechanism or sump directly.

In practice, a small amount of liquid still may still enter the compression mechanism and/or sump via one or more "bleed holes" or metering ports located in the suction feed pipe and connecting its passage with the storage volume. A metering port is necessary to prevent accumulation of oil that normally circulates through the system with refrigerant in small percentages. Upon reaching the accumulator inlet pipe via piping connecting the evaporator and accumulator, oil may be in any or all of several forms. Oil may arrive as a film on interior walls, pushed along by the flow of refrigerant vapor. Oil may also arrive in mixture with or solution with liquid refrigerant. Some oil may also be entrained in refrigerant vapor as a mist. The circuitous path used to divert liquid refrigerant into the storage volume is also effective in diverting oil into the storage volume. Additionally, when oil enters the accumulator as a mist entrained in refrigerant vapor, the circuitous path requires changes in flow velocity and direction and may enhance flow impingement with some of the accumulator's internal solid surfaces. These tend to cause some portion of any oil entrained in the flowing refrigerant vapor to become separated out, where it flows to and collects at the bottom of the accumulator as a consequence of gravity.

Without a least one metering hole, over time the accumulator storage volume might become filled with separated oil. As accumulator storage volumes are typically a considerable fraction of oil sump volumes, and may exceed oil sump volumes, the resulting reduction of oil level in compressor sump could very well result in eventual failure by loss of lubrication. To minimize the amount of residual oil that may be prevented from returning to the compressor sump, at least one metering port is conventionally located near the bottom of the accumulator storage volume. In instances where an immiscible or partially miscible oil is used, metering ports are located at several elevations along the suction feed pipe of the accumulator. In this way, oil or an oil-rich mixture of oil and refrigerant floating on top of liquid refrigerant can be fed into the suction feed pipe. For these cases, at least one metering port is still located near the bottom of the storage volume to minimize the amount of residual oil that may be trapped in the accumulator when no liquid refrigerant is present. The lowest practical location of a metering hole in conventional accumulators is determined by manufacturing process and assembly tolerances. Typically, a metering hole may be located such that, for the worst-case assembly, trapped residual liquid volume may be a fraction of a fluid ounce in a small accumulator to as much as about a fluid ounce (30 cc) in a large accumulator. In conventional accumulators, trapped residual liquid volumes are on the order of a few percent to, in extreme cases, perhaps as much as 10% of the accumulator liquid storage volume.

When the storage volume contains liquid refrigerant, the metering port allows liquid refrigerant to flow into the suction feed pipe as well as oil. Accumulators can still be effective as long as the metering port is correctly sized and the amount of liquid refrigerant entering the accumulator does not exceed its storage capacity. If the metering port is too large, then, during operation with liquid refrigerant entering the accumulator, the flow rate of liquid refrigerant metered into the suction feed pipe may exceed rates required for reliable operation. If the metering port is too small or the accumulator storage capacity is too small for the system refrigerant charge, then liquid refrigerant may overflow the inlet of the suction feed pipe. If this happens, the rate of liquid flow to the compression mechanism and/or oil sump could be substantially increased. As this liquid is predominantly liquid refrigerant, washing of oil films from moving parts and/or dilution of oil in the sump may result.

As mentioned earlier, another effective and desirable approach is to design the compressor oil sump to hold an amount of oil that is at least about 30 to 40% of the system refrigerant charge amount, and preferably greater. Trends in system design are making this increasingly difficult and costly, however. Increasingly, consumer preference is towards systems with longer refrigerant connection lines and multiple indoor units serviced by a single outdoor unit and compressor. Both of these trends may result in systems with increased refrigerant charge amounts.

Redesigning compressor shells to increase oil sump volume may be costly, particularly insofar as these increases may exceed the capabilities of existing capital equipment. Simply adding additional oil to compressors without changing the volumes of their sumps may also be undesirable. The resulting increase in oil level may cause increased oil circulation rates due to impingement by moving parts or entrainment in discharged gas. Increased oil circulation rate, in turn, could degrade performance of heat transfer surfaces, thereby causing a loss of system efficiency.

If additional oil storage could be provided in a cost-effective manner in a compressor component that refrigerant may enter and leave, the oil to refrigerant ratio of the system could be increased without increasing the storage capacity of the oil sump. Further, if this additional oil storage could be provided in the suction accumulator, then during those times when primarily liquid refrigerant would otherwise be delivered to the compressor, a mixture of liquid refrigerant and oil would be delivered, having much better lubricating ability than liquid refrigerant. After oil has left the accumulator in this manner, a subsequent period of normal operation would allow the liquid separating mechanisms inherent in suction accumulators to replenish the oil stored in the accumulator, thereby allowing the additional oil stored in the accumulator to perform its functions repeatedly during the life of the system.

SUMMARY OF THE INVENTION

The present invention increases the amount of oil in an air conditioning, heat pump, or refrigeration system by increasing the residual liquid storage volume in a suction-side accumulator and providing an additional oil charge amount to fill a portion of the increased residual liquid storage volume. This is accomplished by raising the metering port location on the suction feed pipe so that it is no longer near the bottom of the liquid storage volume. If it is desired to maintain the same storage volume available for holding liquid refrigerant, then the total storage volume of the accumulator may also be increased by an amount corresponding to the increase of the residual liquid storage volume.

It is an object of this invention to add oil to a system without having it normally retained in the compressor shell that houses the compressor motor and pump set.

It is another object of this invention to increase the oil to refrigerant ratio in a refrigeration, air conditioning, or heat pump system.

It is another object of this invention to increase the lubricating quality of liquid entering the compressor from a suction-side accumulator when a substantial portion of that liquid is refrigerant. These objects, and others as will become apparent hereinafter, are accomplished in the present invention.

Basically, the total oil charge in a system containing a compressor with a suction-side accumulator is increased by raising the lowest metering port in the suction feed pipe of the accumulator and by filling a portion of the resulting residual liquid storage volume thereby created with additional oil. This additional oil may be charged directly into the accumulator or into the compressor oil sump. If charged into the sump, it will eventually fill a portion of the residual oil storage volume of the accumulator after a period of compressor operation, due to the oil separating tendencies of the accumulator described earlier. If it is desirable not to sacrifice volume available for storing liquid refrigerant, then the total accumulator storage volume may be increased in conjunction with raising the lowest metering port and adding additional oil.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
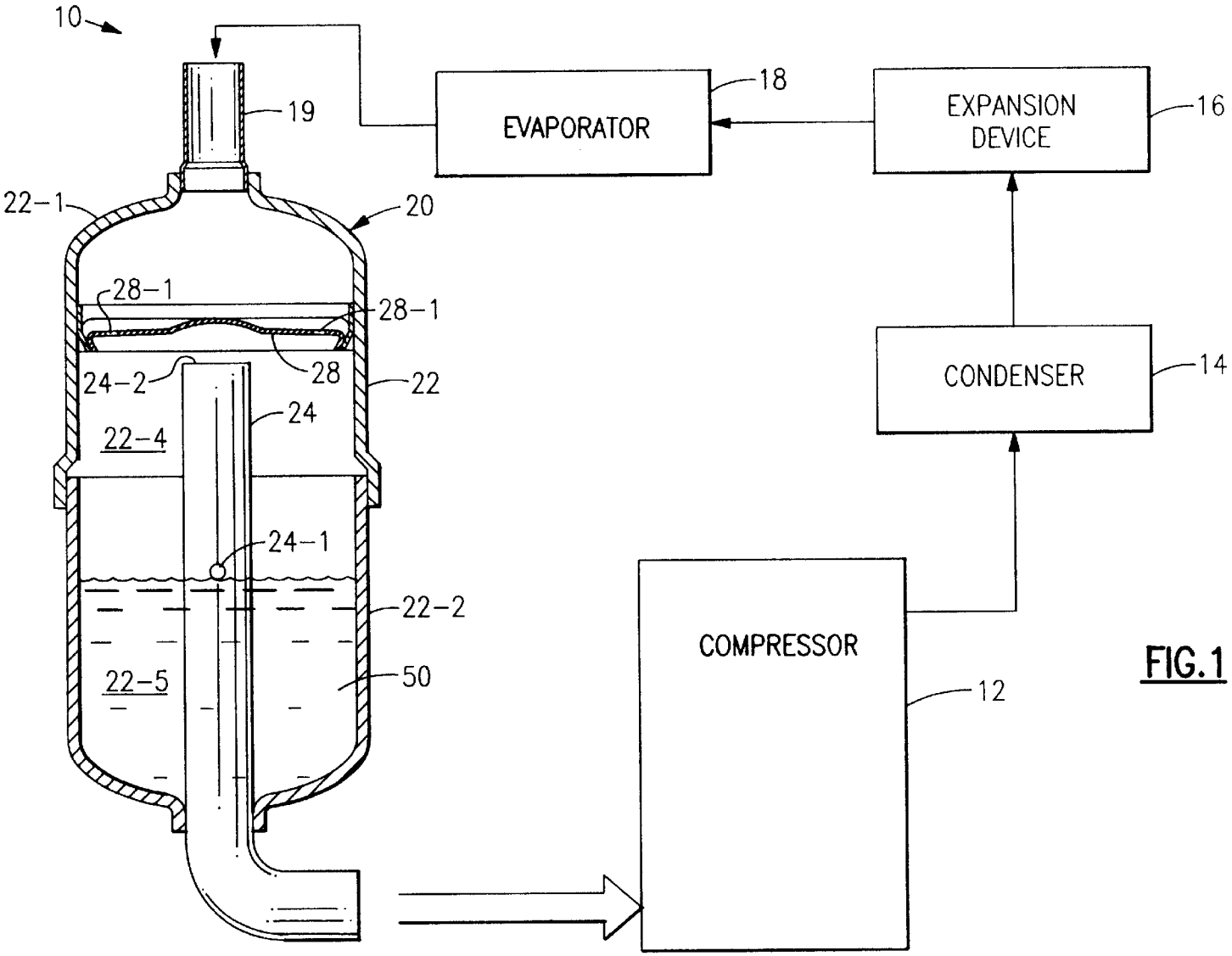
FIG. 1 is a sectional view of the accumulator of the present invention located in a schematic refrigeration, air conditioning, or heat pump system.

In FIG. 1, the numeral 12 generally designates a hermetic compressor in a closed refrigeration, air conditioning, or heat pump system 10. Starting with compressor 12, the system 10 serially includes compressor 12, condenser 14, expansion device 16, evaporator 18 and accumulator 20.

In operation of the system 10, hot, high pressure refrigerant gas with a small percentage of entrained oil from compressor 12 is supplied to condenser 14 where the refrigerant gas condenses to a liquid which is supplied to expansion device 16. Entrained oil is carried with the liquid refrigerant. Expansion device 16 causes a pressure drop and partial flashing of the liquid refrigerant passing therethrough. Some or all of the liquid refrigerant supplied to evaporator 18 evaporates. Gaseous refrigerant, along with any liquid refrigerant and oil, is supplied to accumulator 20 through its inlet pipe 19. In accumulator 20, any liquid refrigerant and oil and some of any oil mist entrained in gaseous refrigerant is separated from the gaseous refrigerant and diverted to the accumulator liquid storage volume 22-4 overlying residual liquid storage volume 22-5 by the circuitous path created by the locations of passage holes 28-1 in baffle 28 relative to the inlet 24-2 of suction feed pipe 24, and with the aid of gravity. The gaseous refrigerant passes into the suction feed pipe 24 through its inlet 24-2 and then to compressor 12 to complete the cycle. As is conventional, separated oil or a mixture or solution of separated oil and liquid refrigerant is supplied to compressor 12 in metered fashion as long as the level of separated liquid(s) in accumulator 20 is up to or above metering hole 24-1 in suction feed pipe 24 and below the inlet 24-2 of suction feed pipe 24.

During periods when system 10 is not in operation and the temperature of compressor 12 is less than the temperature of the condenser 14, refrigerant will migrate from condenser 14 to compressor 12, condense, and collect by the action of gravity in the lowest parts of compressor 12 that are accessible to refrigerant flow from condenser 14.

During periods when system 10 is not in operation and the temperature of accumulator 20 is less than the temperature of the evaporator 18, refrigerant will migrate from evaporator 18 to accumulator 20, condense, and collect by the action of gravity in accumulator storage volume 22-4 and mix with any oil and refrigerant residing in residual liquid storage volume 22-5.

During periods when system 10 is not in operation since the oil used has an affinity for the refrigerant used, refrigerant will migrate from condenser 14 and/or evaporator 18 and form a solution with any oil accessible to refrigerant flow that is contained in compressor 12 and/or the residual liquid storage volume 22-5 and the accumulator liquid storage volume 22-4 of accumulator 20.

The housing 22 of accumulator 20 may consist of an upper housing member 22-1 and a lower housing member 22-2 suitably sealed together, or it may be constructed of a single piece by any suitable means such as rotational forming. Inlet pipe 19 is sealingly secured to housing 22 and is fluidly connected to evaporator 18. Suction feed pipe 24 is sealingly received in housing 22 and extends into the interior of housing 22. A lowest metering port 24-1 is formed in suction feed pipe 24, defining a residual liquid storage volume 22-5 bounded by the portion of interior surface of accumulator housing 22 below a horizontal plane passing through lowest metering hole 24-1 and the portion of exterior surface of suction feed pipe 24 below the same horizontal plane. A liquid storage volume 22-4 overlies residual liquid storage volume 22-5 and is bounded by a horizontal plane lying in the cross-sectional plane of the inlet 24-2 of suction feed pipe 24 and the horizontal plane passing through lowest metering port 24-1, and the portion of interior surface of housing 22 and exterior surface of suction feed pipe 24 lying between these two planes.

The diameter of lowest metering port 24-1 is preferably in the range of 0.02 to 0.06 inches (0.6 to 1.5 mm). Lowest metering port 24-1 is located vertically on suction feed pipe 24 such that the residual liquid volume 22-5 thereby created is 20 to 50% of the combined liquid storage volume 22-4 and residual liquid volume 22-5, with about 33% being the preferred percentage. Said another way, the lowest metering port 24-1 is located vertically on suction feed pipe 24 such that the residual liquid volume 22-5 thereby created is equal in volume to 25 to 100% of the liquid storage volume 22-4 thereby created, with about 50% being the preferred percentage.

The amount of oil added to fill a portion of the residual liquid storage volume 22-5 depends on the solubility characteristics of the oil and refrigerant used. For preferred oil and refrigerant combinations such as alkylbenzene oil and R22, polyolester oil and R410A, and polyvinyl ether oil and R404A or R407C or R410A, a volume of oil equal to 40 to 60% of the residual liquid storage volume 22-5 would typically be added.

Figure 2:
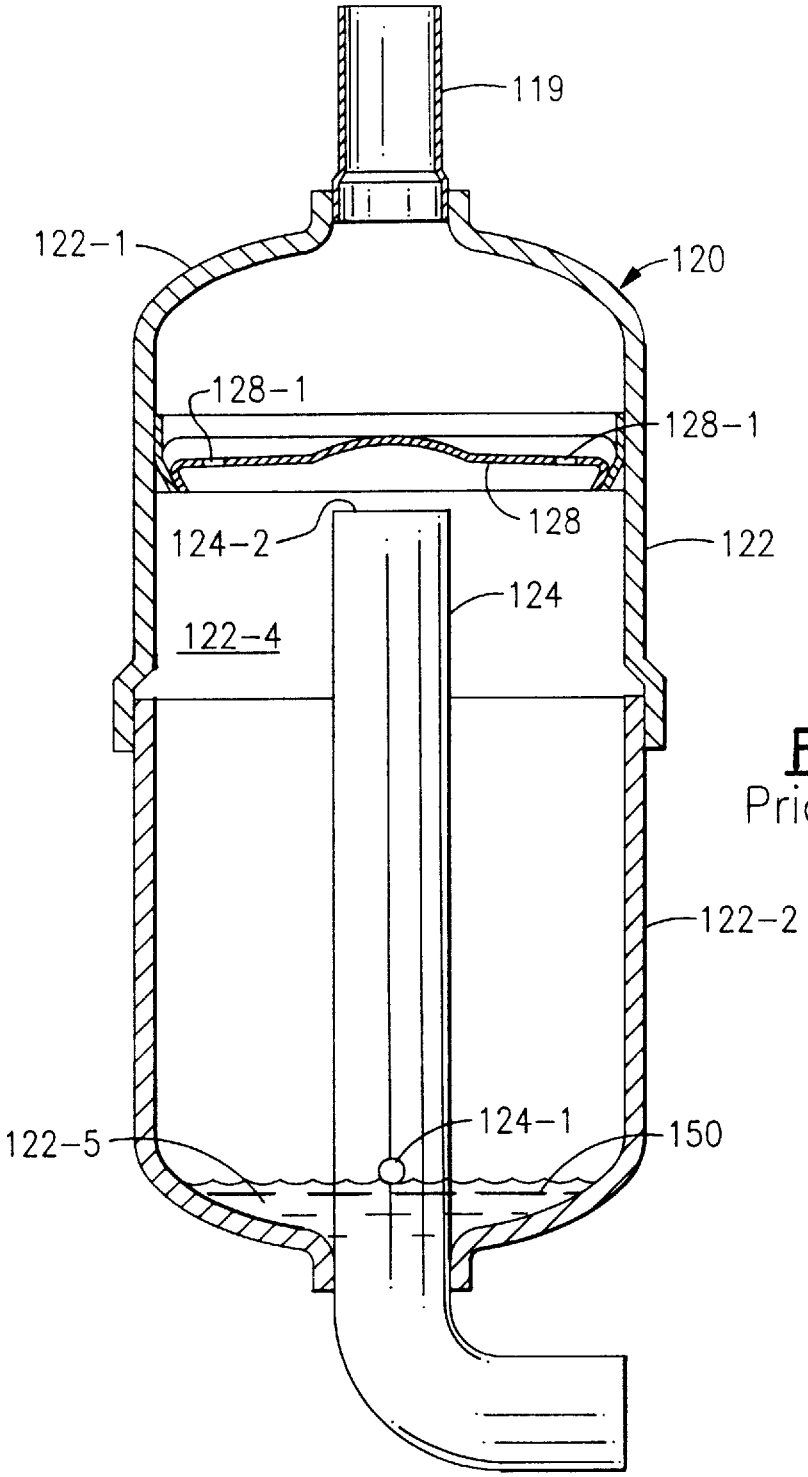
FIG.2 Prior Art
FIG. 2 is PRIOR ART accumulator.

Referring now to FIG. 2, a PRIOR ART accumulator 120 is illustrated which differs from accumulator 20 in the location of lowest metering port 124-1 but is otherwise the same as accumulator 20. However, all corresponding parts of accumulator 120 have been numbered one hundred higher than those parts of accumulator 20. The location of lowest metering port 124-1 is such that the residual liquid in accumulator 120 is on the order of a few percent, say less than 10%, of the combined accumulator storage and residual liquid volumes.

In operating systems with accumulators 20 and 120, respectively, the residual liquid 50 and 150, respectively, will be oil or, due to their affinity, a solution of oil and liquid refrigerant which is at a level corresponding to metering ports 24-1 and 124-1, respectively. When the system 10 is shut down, at some time accumulators 20 and 120 and liquids 50 and 150 may cool to a temperature at or below the temperature of evaporator 18. Due to this temperature difference, refrigerant will migrate from evaporator 18 and condense in cooler locations. Refrigerant condensing in accumulators 20 and 120, respectively, will fall due to the action of gravity and dilute the oil or oil-refrigerant solutions 50 and 150, respectively. Even if refrigerant condensing in this manner into accumulator 120 only fills a substantial portion of its accumulator storage volume 122-4, say 50% or more, the mixture or solution resulting from mixing of this liquid refrigerant in storage volume 122-4 with residual liquid 150 in residual liquid storage volume 122-5 will contain a very low percentage of oil. It will be primarily refrigerant. However, if refrigerant condensing in this manner into accumulator 20 fills a substantial portion of its accumulator storage volume 22-4, say 50% or more, the mixture or solution resulting from mixing of this liquid refrigerant in storage volume 22-4 with residual liquid 50 in residual liquid storage volume 22-5 will contain a substantial percentage of oil. For the same amount of liquid refrigerant condensing into accumulators 20 and 120 and mixing with residual oil contained therein, the percentage of oil in the resulting liquid in accumulator 20 would be about fifteen times greater than the percentage of oil in the resulting liquid in accumulator 120.

After the system 10 has been idled and refrigerant has migrated back to accumulators 20 and 120 respectively, upon start-up accumulator 120 will deliver primarily refrigerant to compressor 12 through metering port 124-1 and possibly by overflowing of suction feed pipe inlet 124-2. Accumulator 20, however, would deliver relatively oil rich liquid to compressor 12 via metering port 24-1 and possibly by overflowing of suction feed pipe inlet 24-2.

If a flooded compressor oil sump has also occurred due to refrigerant migration during the time system 10 was idle, at start-up oil may be entrained in liquid refrigerant leaving the compressor and be carried out of the sump. In this instance, the liquid delivered by accumulator 120 is primarily liquid refrigerant and will only tend to cause more oil to be carried out of the sump. However, the relatively oil-rich liquid supplied to the compressor by accumulator 20 will replace at least some of the oil that might have been carried out of the compressor. As system 10 operates, the oil carried out of the sump will pass through condenser 14, expansion device 16, evaporator 18, and eventually reach accumulator 20, where the liquid-separating mechanisms inherent in its design will tend to divert it to residual liquid storage volume 22-5, thereby replacing oil that left the accumulator during the start-up event.

During normal operation with an oil and refrigerant for which the refrigerant is soluble in the oil, the residual liquid 50 will consist of a solution of oil and refrigerant. If the solubility characteristics of the oil and refrigerant depend on temperature and/or pressure, as is typical, then the percentage of oil in the residual liquid 50 will vary depending on operating temperature and/or pressure in the accumulator 20. At some pressure and temperature conditions, some of the additional oil added to partially fill the residual liquid storage volume 22-5 may be displaced by refrigerant dissolving into the oil. Oil displaced from residual liquid storage volume 22-5 in this manner will subsequently reside in other portions of system 10 such as the compressor oil sump. During later operation at nominal conditions for which the volume of oil added to partially fill residual liquid storage volume 22-5 was selected, the displaced oil will eventually be carried out of the sump, pass through condenser 14, expansion device 16, evaporator 18, and eventually reach accumulator 20, where the liquid-separating mechanisms inherent in its design will tend to divert it to residual liquid storage volume 22-5. In this manner, the additional oil added to partially fill residual liquid storage volume 22-5 will be correctly located to perform its function repeatedly during the life of the system.

Although a preferred embodiment of the present invention has been described and illustrated, other modifications will occur to those skilled in the art. It is therefore intended that the present invention is to be limited only by the scope of the appended claims.

What is claimed is:

1. In a closed refrigeration system containing refrigerant and oil which form a solution and serially including a compressor, a condenser, an expansion device, an evaporator and a suction accumulator, said suction accumulator comprising:

a housing;

means connected to said evaporator for supplying said refrigerant and oil vertically downward into said housing;

a suction feed pipe fluidly connected to said compressor and having an open end extending upwardly in said housing;

a volume located in said housing and having an upper limit defined by said open end;

a lowest metering hole located in said suction feed pipe at a vertical extent such that at least 20% of said volume is located at a lower level than said lowest metering hole; and said accumulator contains an oil-refrigerant solution containing an amount of oil equal to at least 40% of said volume below said lowest metering hole.

2. The suction accumulator of claim 1 wherein said lowest metering hole has a diameter of 0.02 to 0.06 inches.

* * * * *